US008819925B2

(12) United States Patent
Onuma et al.

(10) Patent No.: US 8,819,925 B2
(45) Date of Patent: Sep. 2, 2014

(54) TERMINAL CRIMPING APPARATUS

(75) Inventors: Masanori Onuma, Makinohara (JP); Kosuke Takemura, Makinohara (JP)

(73) Assignee: Yuzuki Corporation, Tokyo (JP)

( * ) Notice: Subject to any disclaimer, the term of this patent is extended or adjusted under 35 U.S.C. 154(b) by 0 days.

(21) Appl. No.: 13/383,133

(22) PCT Filed: Jun. 22, 2010

(86) PCT No.: PCT/JP2010/060589

§ 371 (c)(1),
(2), (4) Date: Feb. 13, 2012

(87) PCT Pub. No.: WO2011/004704

PCT Pub. Date: Jan. 13, 2011

(65) Prior Publication Data

US 2012/0124826 A1 May 24, 2012

(30) Foreign Application Priority Data

Jul. 10, 2009 (JP) ..... 2009-163573
Nov. 12, 2009 (JP) ..... 2009-258535

(51) Int. Cl.
*H01R 43/048* (2006.01)
*H01R 4/18* (2006.01)

(52) U.S. Cl.
CPC ..... *H01R 43/0486* (2013.01); *H01R 4/185* (2013.01)
USPC ..... 29/753

(58) Field of Classification Search
CPC ..... H01R 43/0486
USPC ..... 29/753
See application file for complete search history.

(56) References Cited

U.S. PATENT DOCUMENTS

| | | | | |
|---|---|---|---|---|
| 2,600,012 | A * | 6/1952 | Macy | 439/877 |
| 5,101,651 | A | 4/1992 | Yeomans | |
| 6,813,826 | B2 | 11/2004 | Ito et al. | |
| 2008/0209716 | A1 | 9/2008 | Yagi et al. | |
| 2009/0163088 | A1 | 6/2009 | Yamagami | |

FOREIGN PATENT DOCUMENTS

| | | | |
|---|---|---|---|
| CN | 101227054 | A | 7/2008 |
| CN | 101465478 | A | 6/2009 |
| DE | 4014221 | A1 * | 11/1990 |
| JP | 7169548 | A | 7/1995 |
| JP | 2000138087 | A | 5/2000 |
| JP | 200773379 | A | 3/2007 |

(Continued)

OTHER PUBLICATIONS

Machine translation of DE 4014221 Al, obtained Feb. 15, 2014.*

(Continued)

*Primary Examiner* — Livius R Cazan
(74) *Attorney, Agent, or Firm* — Sughrue Mion, PLLC

(57) ABSTRACT

There is provided a terminal crimping apparatus which can detect a crimping failure mode which produces a transversely asymmetrical crimped shape in a crimped product. The terminal crimping apparatus includes an anvil (102A) which is a lower die on which a conductor crimping portion (11) of a terminal (10) is place and a crimper (101A) which is an upper die which bends inwards a pair of left and right crimping pieces (11L, 11R) of the conductor crimping portion (11), and the terminal crimping apparatus further includes a detection device which detects a transversely unbalanced load in the upper and lower dies (101A, 101B) in a crimping process in which the upper die (101A) is pressed down towards the lower die (102A) so as to crimp the pair of left and right crimping pieces (11L, 11R) on to a conductor (Wa) of an electric wire so as to crimp the conductor (Wa).

3 Claims, 12 Drawing Sheets

(56) References Cited

FOREIGN PATENT DOCUMENTS

| | | | |
|---|---|---|---|
| JP | 2007073379 A | * | 3/2007 |
| JP | 2007109517 A | | 4/2007 |

OTHER PUBLICATIONS

International search Report dated Aug. 3, 2010 in counterpart international application No. PCT/JP2010/060589.

Written Opinion of the International Searching Authority dated Aug. 3, 2010 in counterpart international application No. PCT/JP2010/060589.

Office Action dated Sep. 3, 2013 issued by the Japanese Patent Office in counterpart Japanese Application No. 2009258535.

Communication dated Nov. 22, 2013, issued by the State Intellectual Property Office of the People's Republic of China in corresponding Application No. 201080031050.6.

* cited by examiner (a)

(b)

(a)

(b)

TERMINAL CRIMPING APPARATUS

TECHNICAL FIELD

The present invention relates to a terminal crimping apparatus for crimping to a conductor of an electric wire a terminal having a conductor crimping portion with a U-shaped cross section which includes a bottom plate and a pair of left and right crimping pieces (namely, wire barrels) which rises from both side edges of the bottom plate which face each other in a transverse direction.

BACKGROUND ART

FIGS. 10(*a*) and (*b*) show a general configuration example of a pressure connection terminal. A conductor crimping portion 11 and a cover crimping portion 12 are provided at a rear portion of a terminal 10 in a position situated at a front and a position situated at a rear of the rear portion, respectively. The conductor crimping portion 11 has a U-shaped cross section and has a bottom plate 11A which is a common substrate of the terminal 10 which extends over an overall length thereof and a pair of left and right crimping pieces 11L, 11R which rise from side edges of the bottom plate 11A which face each other in a transverse direction. Likewise, the cover crimping portion 12 has a U-shaped cross section and has a bottom plate 12A and a pair of left and right crimping pieces 12L, 12R which rise from side edges of the bottom plate 12A which face each other in the transverse direction.

When connecting this terminal 10 to an electric wire W, firstly, a conductor Wa which is exposed by removing an insulation cover Wb at an end portion of the electric wire W is placed on the bottom plate 11A of the conductor crimping portion 11, and a portion of the electric wire W which is adjacent to the exposed conductor Wa and is still covered by the insulation cover Wb is placed on the bottom plate 12A of the cover crimping portion 12. Next, in this state, as FIG. 10(*c*) shows, a crimper (that is, an upper die) 101A and an anvil (that is, a lower die) 102A of a terminal crimping apparatus are driven to press the pair of left and right crimping pieces 11L, 11R of the conductor crimping portion 11 so that the crimping pieces are crimped while being rounded inwards by two arch-shaped crimping portions 111L, 111R each made up of an arc-like surface which are provided at a portion of the crimper 101A which faces the anvil 102A, whereby the conductor crimping portion 11 is pressure connected or crimped to the conductor Wa of the electric wire W. At the same time, the pair of left and right crimping pieces 12L, 12R of the cover crimping portion 12 are bent inwards, whereby the portion of the electric wire W which is covered by the insulation cover Wb is fixedly crimped. By crimping the conductor crimping portion 11 and the cover crimping portion 12 in the way described above, the terminal 10 and the electric wire are connected together.

When the terminal 10 and the electric wire W are connected together by means of crimping, it is known that the electrical connection performance and the mechanical connection performance vary depending particularly on the crimping quality between the conductor Wa and the conductor crimping portion 11. Then, a terminal crimping apparatus is proposed which includes a function to determine whether the crimping quality is good or bad by detecting an abnormality during a crimping operation of a terminal (for example, refer to Patent Literature 1).

As FIG. 11 shows, this terminal crimping apparatus 100 has a set of an anvil (that is, a lower die) 102A and a crimper (that is, an upper die) 101A which crimps a conductor crimping portion 11 for pressure connection and a set of an anvil 102B and a crimper 101B which crimps the cover crimping portion 12. By lowering the crimpers 101A, 101B, the terminal 10 and the electric wire W which are inserted between the anvils 102A, 102B and the crimpers 101A, 101B are pressure connected or crimped together. In addition, a pressure sensor 120 is installed in a base portion 110 which supports the anvils 102A, 102B, so that whether or not a proper crimping operation is performed is determined based on waveform data which shows a change with time of loads applied to the anvils 102A, 102B which are detected by the pressure sensor 120.

For example, as FIG. 12 shows, a crimping process is divided into several stages T1 to T3. Then, whether or not a proper crimping is performed is determined by verifying whether or not the characteristic waveforms of loads measured fall within a permissible range S which is set based on a reference waveform A resulting when a normal crimping operation is performed in the individual stages T1 to T3.

RELATED ART LITERATURE

Patent Literature

Patent Literature 1: JP-A-2007-109517

SUMMARY OF THE INVENTION

Problem that the Invention is to Solve

Incidentally, in an actual crimping process, depending on various conditions at the time of crimping, a proper product as shown in FIG. 13(*a*) is produced in which left and right crimping pieces 11L, 11R are crimped to a conductor Wa in a well balanced fashion, and in addition to this, an improper product as shown in FIG. 13(*b*) is produced in which left and right crimping pieces 11L, 11R are crimped to a conductor Wa in an unbalanced fashion. For example, when crimping is performed on an inclined terminal, or when crimping is performed in such a state that a terminal feeding error is caused, or when crimping is performed in such a state that friction coefficients of left and right crimping portions 111L, 111R lack symmetry due to a worn crimper 101A, a transverse distortion tends to be caused easily. Because of this, crimping progresses while a registration error is occurring between the left and right crimping pieces 11L, 11R due to the difference in crimping load at the left and right crimping portions 111L, 111R, and the resulting crimped shape tends to be transversely unbalanced.

The transversely unbalanced crimped shape represents one of crimping failure modes. However, it has been difficult to detect this crimping failure mode by the conventional terminal crimping apparatus which has the crimping quality determination function that has been described above since the loads are only monitored by the pressure sensor 120 which is disposed in one location on the anvil side.

In consideration of these situations, an object of the invention is to provide a terminal crimping apparatus which can detect the crimping failure mode producing the transversely asymmetrical or unbalanced crimped shape.

Means for Solving the Problem (1) With a view to solving the problem, according to the invention, there is provided a terminal crimping apparatus comprising a lower die on which a bottom plate of a conductor crimping portion of a terminal is placed, the conductor crimping portion being made up of the bottom plate and a pair of left and right crimping pieces which rise from side edges of the bottom plate which face each other in a transverse direction, and an upper die which is disposed above the lower die so as to press the crimping pieces of the conductor crimping portion between the lower die and itself and which has two arch-shaped crimping portions each made up of an arc-like surface and formed at a portion thereof which faces the lower die so as to bend inwards the pair of left and right crimping pieces, wherein the bottom plate of the conductor crimping portion of the terminal is placed on the lower die, a distal end portion of a conductor of an electric wire is placed on the bottom plate, and in this state, the upper die is relatively pressed towards the lower die so as to round inwards the pair of left and right crimping pieces so that the crimping pieces are pressure connected to the conductor of the electric wire, the terminal crimping apparatus further comprising a detection device configured to detect a transversely unbalanced load applied to the upper and lower dies in a crimping process in which the upper die is relatively pressed towards the lower die so that the pair of left and right crimping pieces are crimped for pressure connection to the conductor of the electric wire.

(2) In the terminal crimping apparatus described under (1) above, it is preferable that as the detection device, pressure sensors are disposed in two transversely symmetrical locations on the upper die so as to detect pressures in the two locations, so that the transversely unbalanced load is detected based on a difference in detection data from the individual pressure sensors.

(3) In the terminal crimping apparatus described under (2) above, it is preferable that contact surface pressure sensors are disposed as the pressure sensors in two positions which are situated between facing close attaching surfaces of the upper die and a support member which supports the upper die and which are transversely symmetrical.

(4) With a view to solving the problem, according to the invention, there is provided a terminal crimping apparatus comprising a lower die on which a bottom plate of a conductor crimping portion of a terminal is placed, the conductor crimping portion being made up of the bottom plate and a pair of left and right crimping pieces which rise from side edges of the bottom plate which face each other in a transverse direction, and an upper die which is disposed above the lower die so as to press the crimping pieces of the conductor crimping portion between the lower die and itself and which has two arch-shaped crimping portions each made up of an arc-like surface and formed at a portion thereof which faces the lower die so as to bend inwards the pair of left and right crimping pieces, wherein the bottom plate of the conductor crimping portion of the terminal is placed on the lower die, a distal end portion of a conductor of an electric wire is placed on the bottom plate, and in this state, the upper die is relatively pressed towards the lower die so as to round inwards the pair of left and right crimping pieces so that the crimping pieces are pressure connected to the conductor of the electric wire, the terminal crimping apparatus further comprising a detection device configured to detect a vertically unbalanced distortion in at least two locations on the lower die which are spaced apart in a transverse direction in a crimping process in which the upper die is relatively pressed towards the lower die so that the pair of left and right crimping pieces are crimped for pressure connection to the conductor of the electric wire.

(5) In the terminal crimping apparatus described under (4) above, it is preferable that as the detection device, distortion gauges are disposed in two locations on a pair of transversely symmetrical lateral surfaces of the lower die, so that the vertical unbalance is detected based on a difference in detection data from the individual distortion gauges.

(6) In the terminal crimping apparatus described under (5) above, it is preferable that vertical surfaces are provided at upper portions of a pair of transversely symmetrical lateral surfaces of the lower die so as to maintain a transverse width of the lower die constant, inclined surfaces are provided below the vertical surfaces so as to expand the transverse width of the lower die as it extends downwards, the inclined surfaces are formed of concave arc surfaces which are continuous smoothly with the vertical surfaces, and the distortion gauges are affixed on to the vertical surfaces or boundaries between the vertical surfaces and the arc surfaces.

Advantage of the Invention

According to the invention described under (1) above, the terminal crimping apparatus includes the detection device which detects the transversely unbalanced load applied to the upper and lower dies during the crimping process. Therefore, the crimping failure can be detected which produces the transversely asymmetrical shape due to the unbalanced load. In addition, the detection is carried out as part of an inspection based on the load applied during the crimping operation, and therefore, crimped products can be subjected to a total non-destructive inspection.

According to the invention described under (2) above, the pressures in the two transversely symmetrical locations on the upper die are detected by the pressure sensors, so that the transversely unbalanced load is detected based on the difference in detection data from the individual pressure sensors. Therefore, the loads in the left and right locations on the upper die can relatively be compared with each other. Even when production errors are generated in upper dies, a threshold of a determination criterion does not have to be severe.

According to the invention described under (3) above, the contact surface pressure sensors are disposed as the pressure sensors in the two positions which are situated between the facing close attaching surfaces of the upper die and the support member which supports the upper die and which are transversely symmetrical. Therefore, almost no load resulting when the upper die and the lower die are clamped together is applied to the contact surface pressure sensors, and only a load in a lateral direction (that is, in a horizontal direction) which is at right angles to a direction in which the press load is applied is mainly applied to the contact surface pressure sensors. Because of this, no pressure sensor having such a large capacity as to bear a high load is necessary, and a low-load contact surface pressure sensor having a small capacity only has to be used. Thus, the terminal crimping apparatus can be realized through a small-scale parts replacement. In addition, a thin contact surface pressure can be used from the configuration in which the contact surface pressure sensors are disposed between the facing close attaching surfaces of the upper die and the support member, and therefore, it is possible to detect not a pinpoint load but a load acting over a wide area which allows a certain degree of inclination to be taken into consideration. In addition, when data are analyzed by use of a sensor which detects a large load as in the conventional example, it has been difficult to detect a crimping failure mode with a small load change. However, by use of the small load contact surface pressure sensors, it is possible to detect a crimping failure mode with a small load change like a crimping failure mode which produces a transversely asymmetrical crimped shape in an ensured fashion.

According to the invention described under (4) above, the terminal crimping apparatus includes the detection device configured to detect a vertically unbalanced distortion in at least the two locations on the lower die which are spaced apart in the transverse direction in the crimping process. Therefore, it is possible to detect easily a crimping failure mode which produces a transversely asymmetrical crimped shape attributed to an unbalanced crimping load. In addition, the detection is the inspection based on the distortion generated in the lower die when crimping is carried out, and therefore, crimped products can be subjected to a non-destructive total inspection.

According to the invention described under (5) above, the unbalanced distortion in the lower die is detected by the distortion gauges disposed in the two locations on the pair of lateral surfaces of the lower die, and therefore, even when production errors are generated in lower dies, a threshold of a determination criterion does not have to be severe. In addition, the distortion gauges only have to be affixed to the lateral surfaces of the lower die, and therefore, a large pressure sensor having a large capacity which can bear a high load does not have to be used although used in the conventional example, thereby making it possible to realize a reduction in equipment costs. In addition, when data are analyzed by use of a sensor which detects a large load as in the conventional example, it has been difficult to detect a crimping failure mode with a small load change. However, by analyzing data using the distortion gauges which are affixed to the lateral surfaces of the lower die, it is possible to detect a crimping failure mode with a small load change like a crimping failure mode which produces a transversely asymmetrical crimped shape in an ensured fashion.

According to the invention described under (6) above, a vertical distortion generated in the lateral surfaces of the lower die can be detected with good accuracy, thereby making it possible to increase the accuracy with which a crimping failure is determined.

BRIEF DESCRIPTION OF THE DRAWINGS

FIG. 1(*c*) is a characteristic chart showing a difference in shape between left and right load waveforms detected by the contact surface pressure sensors.

MODE FOR CARRYING OUT THE INVENTION

Figure 1:
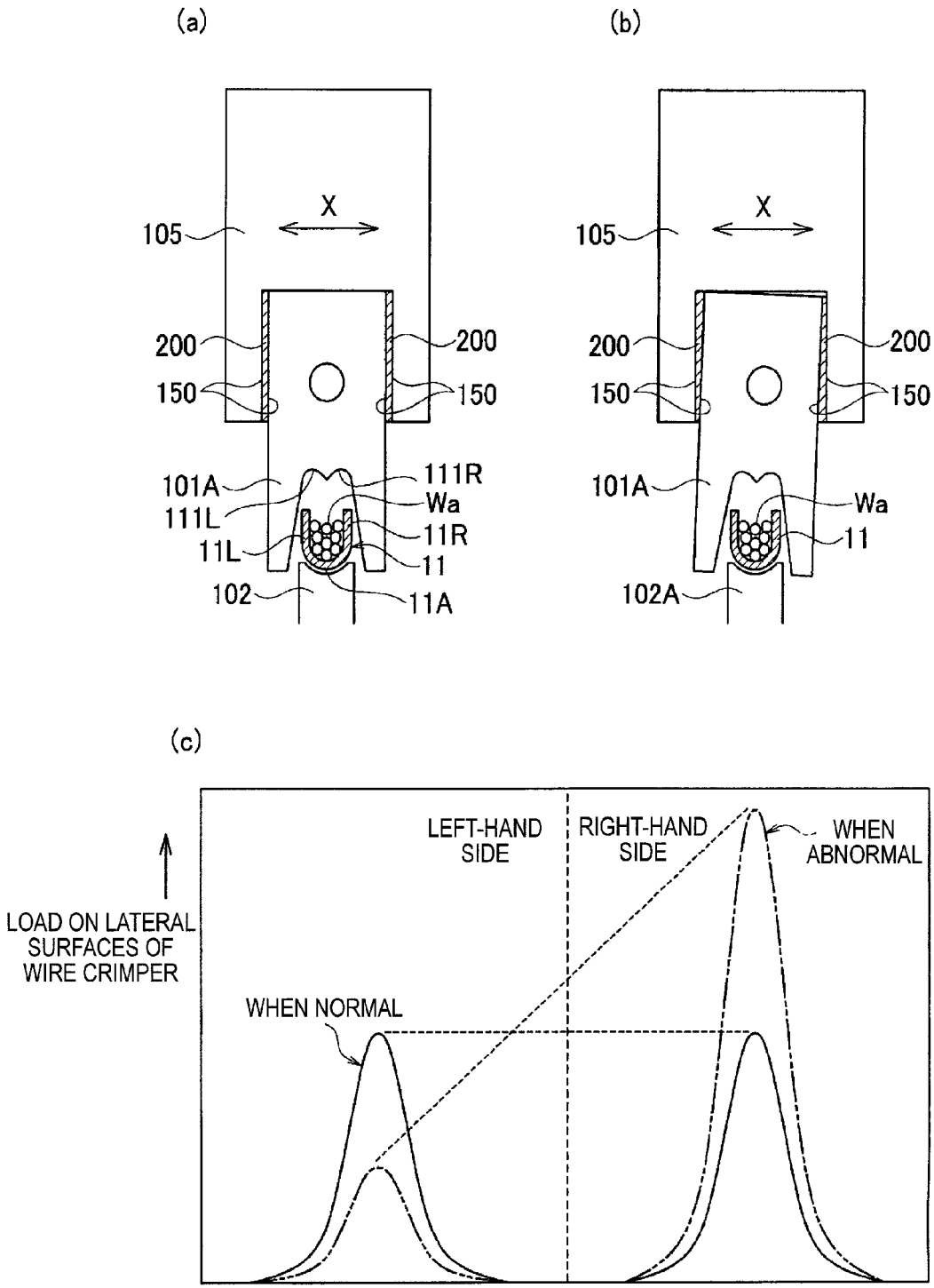
FIGS. 1(*a*) and (*b*) are drawings showing a main part of a terminal crimping apparatus of a first embodiment of the invention which incorporates load detection contact surface pressure sensors, of which (a) shows a state in which a proper crimping is performed and (b) shows in an exaggerated fashion a state in which an abnormal crimping is performed as a result of a transverse shift in load.

Hereinafter, referring to the drawings, embodiments of the invention will be described.

First Embodiment

FIGS. 1(*a*) and (*b*) are drawings showing a main part of a terminal crimping apparatus of an embodiment of the invention which incorporates load detection contact surface pressure sensors, of which (*a*) shows a state in which a proper crimping is performed and (*b*) shows in an exaggerated fashion a state in which an abnormal crimping is performed as a result of a transverse shift in load. FIG. 1(*c*) is a characteristic chart showing a difference in shape between left and right load waveforms detected by the contact surface pressure sensors.

Figure 10:
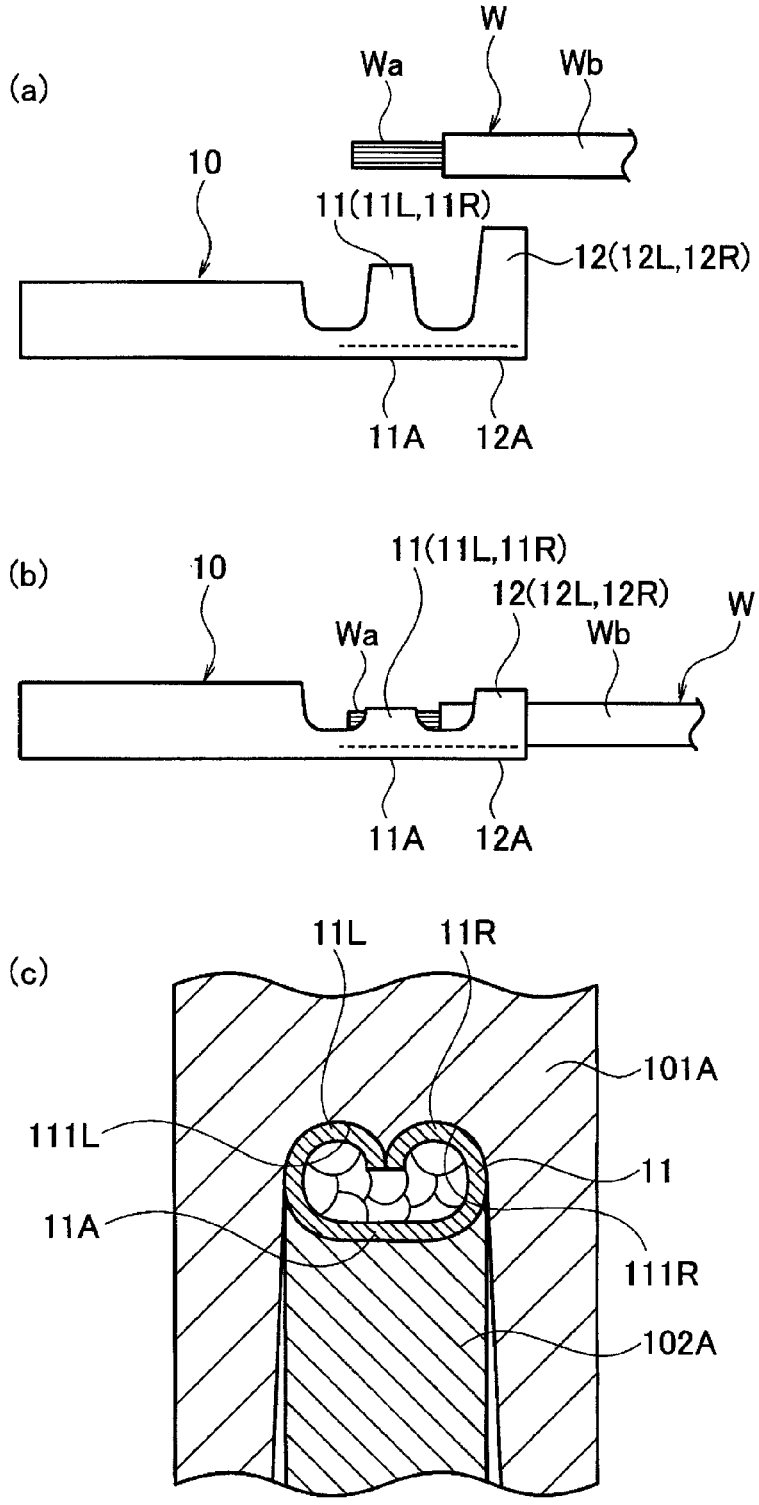
FIG. 10 shows block diagrams of a general pressure connection terminal, of which (a) is a side view showing a state resulting before a terminal and an electric wire are crimped together, (b) is a side view showing a state resulting after the terminal and the electric wire are crimped together, and (c) is a drawing showing a state in which the terminal and the electric wire are crimped together by the crimper and the anvil.

Similar to the terminal shown in FIGS. 10(*a*) and (*b*), a terminal which is to be crimped by a terminal crimping apparatus of a first embodiment of the invention has a conductor crimping portion 11 and a cover crimping portion 12 which are provided at a rear portion of a terminal 10 in a position situated at a front and a position situated at a rear of the rear portion, respectively. The conductor crimping portion 11 is a conductor crimping portion having a U-shaped cross section including a bottom plate 11A and a pair of left and right crimping pieces 11L, 11R which rise from side edges of the bottom plate 11A which face each other in a transverse direction. Likewise, the cover crimping portion 12 has a U-shaped cross section and has a bottom plate 12A and a pair of left and right crimping pieces 12L, 12R which rise from side edges of the bottom plate 12A which face each other in the transverse direction.

Figure 11:
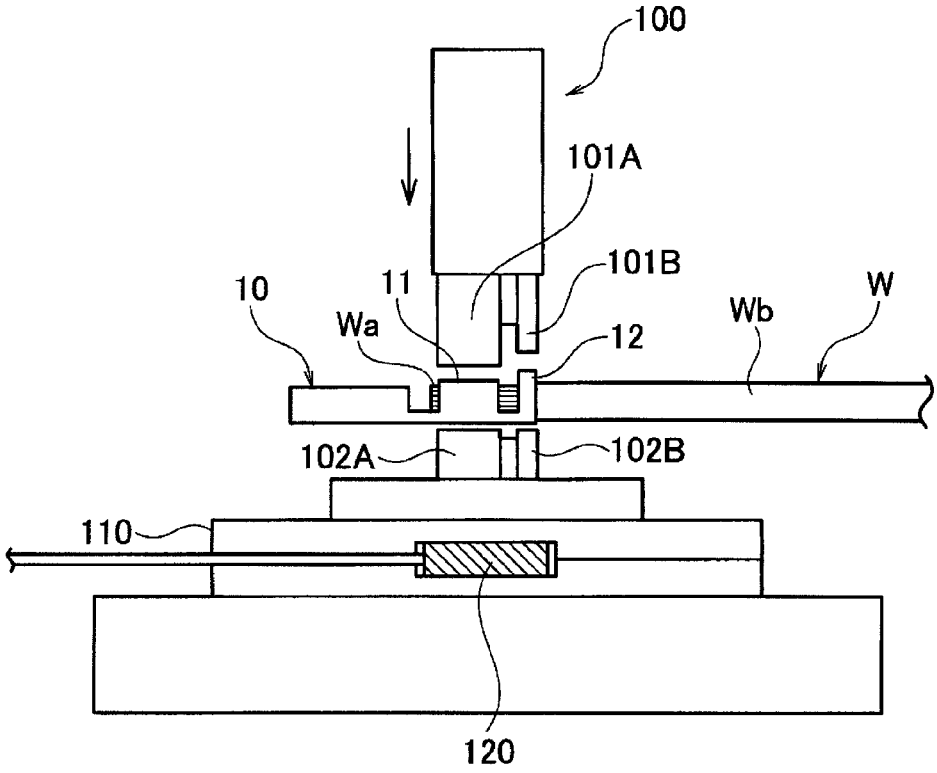
FIG. 11 is a side view showing a schematic configuration of a conventional terminal crimping apparatus.
Figure 12:
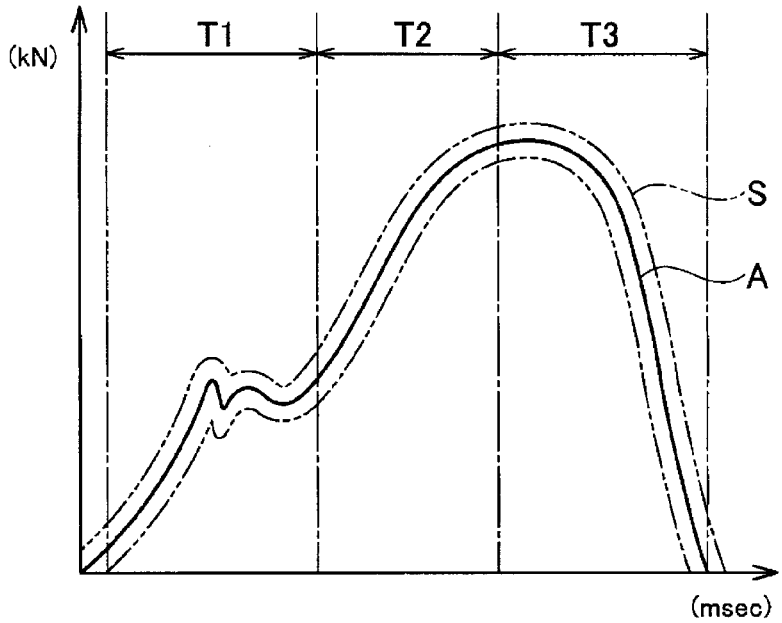
FIG. 12 is a characteristic chart which is used when a crimping condition of the conventional terminal crimping apparatus is determined.
Figure 13:
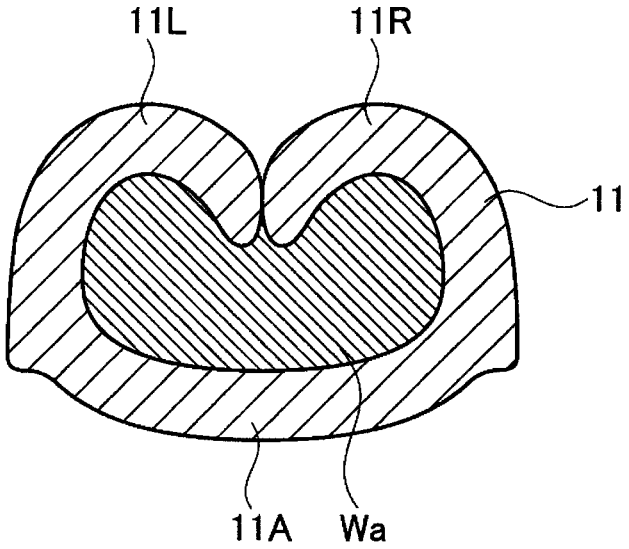
FIG. 13(*a*) is a sectional view of a crimped portion which results when a proper crimping is performed, and (b) shows a sectional view of a crimped portion which results when a transversely asymmetrical crimping is performed.
Figure 13:
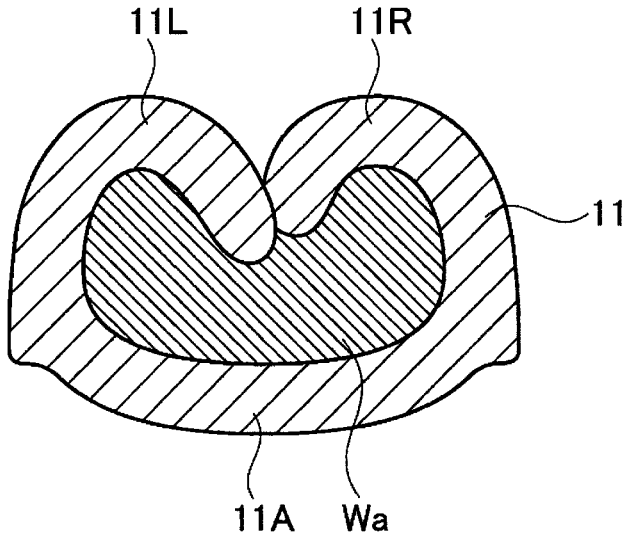

Similar to the terminal crimping apparatus shown in FIG. 11, the terminal crimping apparatus has a set of an anvil (that is, a lower die) 102A and a crimper (that is, an upper die) 101A which crimps the conductor crimping portion 11 for pressure connection and a set of an anvil 102B and a crimper 101B which crimps the cover crimping portion 12. By lowering the crimpers 101A, 101B, the terminal 10 and the electric wire W which are inserted between the anvils 102A, 102B and the crimpers 101A, 101B are pressure connected or crimped together.

Figure 2:
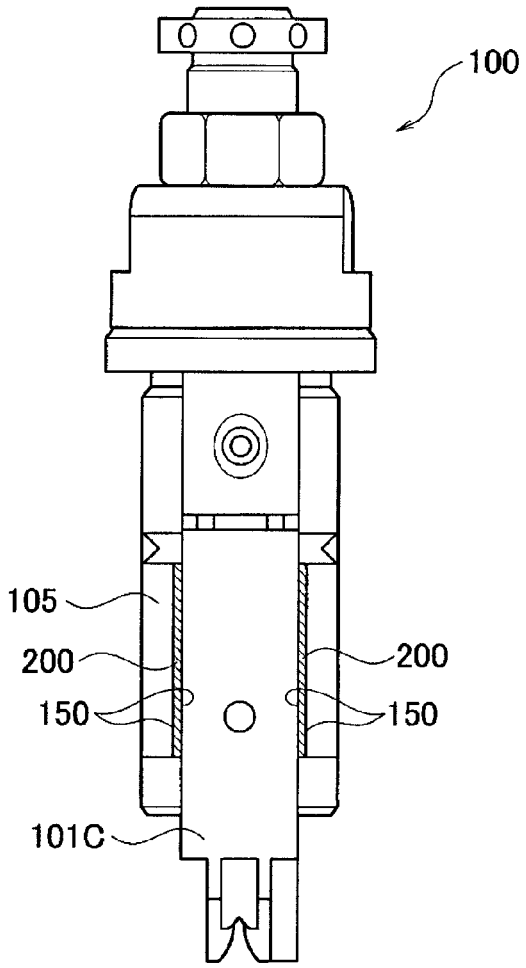
FIG. 2(*a*) is a front view showing the configuration of a crimper side of the terminal crimping apparatus which shows specific locations where the contact surface pressure sensors are disposed, and FIG. 2(*b*) is a bottom view of a crimper portion as viewed from therebelow.
Figure 2:
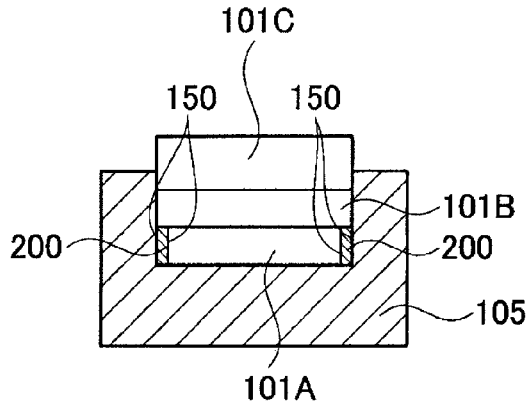

In FIGS. 1 and 2, only the set of the anvil (the lower die) 102A on which the bottom plate 11A of the conductor crimping portion 11 is placed and the crimper (the upper die) 101A which is situated above the anvil 102A are shown. The crimper 101A is caused to rise and fall by a driving mechanism, not shown, and when it is lowered, the crimper 101A presses to crimp a pair of crimping pieces 11L, 11R of the conductor crimping portion 11 together with the anvil 102A. As this occurs, the bottom plate 11A of the conductor crimping portion 11 of the terminal is placed on the anvil 102A, and a distal end portion of a conductor Wa of the electric wire W is placed on the bottom plate 11A. In this state, when the crimper 101A is pressed down towards the anvil 102A relatively, two arch-shaped crimping portions 111L, 111R made up of arc-like surfaces and provided at a portion of the crimper 101A which faces the anvil 102A gradually round inwards the pair of crimping pieces 11L, 11R, and finally, the pair of crimping pieces 11L, 11R are press connected or crimped on to the conductor Wa.

As FIGS. 1(*a*) and (*b*) show, in the terminal crimping apparatus of the first embodiment, contact surface pressure sensors 200 which function as pressure sensors are disposed between facing close attaching surfaces 150 of the crimper 101A and a support member 105 which supports the crimper 101A and in two positions which are transversely symmetrical. As FIG. 1(*c*) shows, an unbalanced load in a transverse direction X is detected based on a difference between detection data detected by the individual contact surface pressure sensors 200.

For example, as FIG. 1(*a*) shows, when left and right loads are almost equal, this shows that the crimper 101A is taking a properly balanced posture, as a result of which as indicated by solid lines in FIG. 1(*c*), waveforms detected by the left and right contact surface pressure sensors 200 have almost the same shape, thereby making it possible to determined that a proper crimping has been performed.

On the other hand, when loads measured at the left and right of the crimper 101A differ, as FIG. 1(*b*) shows, microscopically, the crimper 101A is taking an unbalanced posture, as a result of which as indicated by chain double-dashed lines in FIG. 1(*c*), waveforms detected by the left and right contact surface pressure sensors 200 have different shapes. Thus, it can be determined from the asymmetry in shape between the left and right waveforms that an abnormal crimping has been carried out.

In this way, in the terminal crimping apparatus of the first embodiment, the contact surface pressure sensors 200 which function as pressure sensors are disposed between the facing close attaching surfaces 150 which face each other in the transverse direction X of the support member 105 which supports the crimper 101A, and a transverse unbalanced load between the crimper 101A and the anvil 102A is detected. Therefore, a crimping failure can easily be detected which produces a transversely asymmetrical crimped shape due to the unbalanced load. In addition, the detection is the inspection based on load detected when crimping is performed, and therefore, crimped products can be subjected to a non-destructive total inspection. Further, loads acting at the left and right of the crimper 101A are compared relatively, and therefore, even when production errors are generated in crimpers, a threshold of a determination criterion does not have to be severe.

In addition, almost no load produced when the crimper 101A is pressed down towards the anvil 102A is applied to the contact surface pressure sensors 200, and only a load acting in a lateral direction (a horizontal direction) which is at right angles to a direction in which the press load is applied is mainly applied to the contact surface pressure sensors 200. Therefore, no pressure sensor having such a large capacity as to bear a high load is necessary, and a low-load contact surface pressure sensor 200 having a small capacity only has to be used. Thus, the terminal crimping apparatus can be realized through a small-scale parts replacement.

A thin contact surface pressure 200 can be used from the configuration in which the contact surface pressure sensors 200 are disposed between the facing close attaching surfaces 150 of the crimper 101A and the support member 105, and therefore, it is possible to detect not a pinpoint load but a load acting over a wide area which allows a certain degree of inclination to be taken into consideration.

In addition, when data are analyzed by use of a sensor which detects a large load as in the conventional example, it has been difficult to detect a crimping failure mode with a small load change. However, by use of the small load contact surface pressure sensors 200, it is possible to detect a crimping failure mode with a small load change like a crimping failure mode which produces a transversely asymmetrical crimped shape in an ensured fashion.

In the locations where the contact surface pressure sensors 200 are actually disposed, for example, as FIG. 2(*a*) shows, engagement grooves are provided on a ram 105 which functions as a support member, and the crimper 101A is partially accommodated in the engagement grooves together with a cutting punch 101C. Inner surfaces of the engagement grooves and an outer surface of the crimper 101A constitute the facing close attaching surfaces 150 which face each other in the transverse direction, and therefore, the contact surface pressure sensors 200 only have to be set between the facing close attaching surfaces 150. As this occurs, as FIG. 2(*b*) shows, the contact surface pressure sensors 200 are disposed only in the locations on the conductor crimping portion 11 which correspond to the crimping crimper 101A and are disposed so as not to cover the other portions such as portions corresponding to the crimping crimper 101A of the cover crimping portion and the cutting punch 101C.

In the first embodiment, although the contact surface pressure sensors 200 are described as being disposed between the transversely facing close attaching surfaces 150 of the crimper 101A and the support member 105 which supports the crimper 101A, it is possible to detect an unbalanced load even by disposing pressure sensors so as to detect pressures in two locations on the crimper 101A which are symmetrical in the transverse direction X.

Further, in the first embodiment, by incorporating a detection device such as a displacement sensor or a laser displacement meter for detecting an elongation of the conductor crimping portion 11 when crimping is performed on the support member 105 of the terminal crimping apparatus, behaviors of the terminal 10 which is being elongated can be measured by the detection device so incorporated, thereby making it possible to inspect simply all crimped produces for determination on whether qualities of the crimped products are good or bad while crimping conductor crimping portions 11 thereof.

Second Embodiment

Next, a terminal crimping apparatus of a second embodiment of the invention will be described. In the following description of the second embodiment, like reference numerals will be given to like portions to those of the first embodiment.

Figure 3:
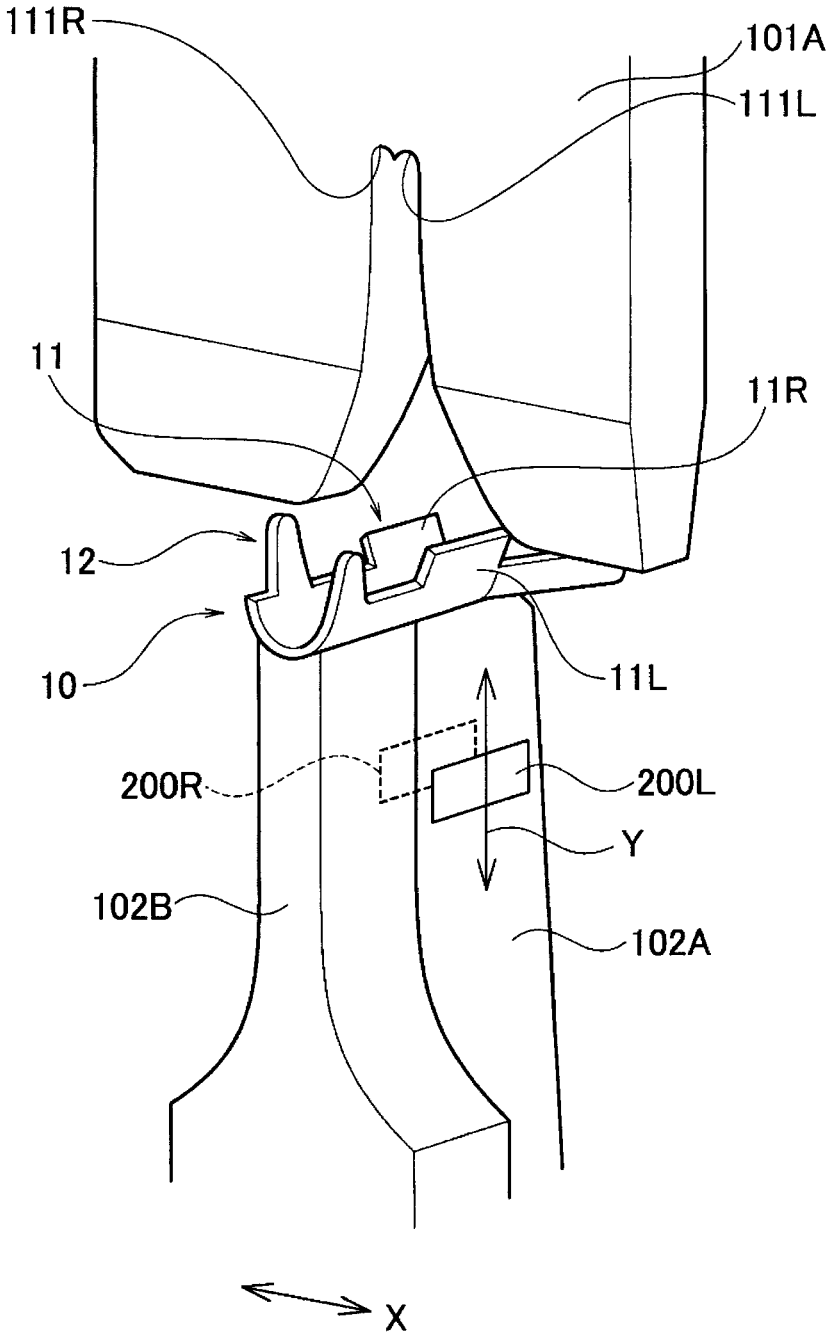
FIG. 3 is a perspective view showing the configuration of a main part of a terminal crimping apparatus of a second embodiment of the invention.
Figure 4:
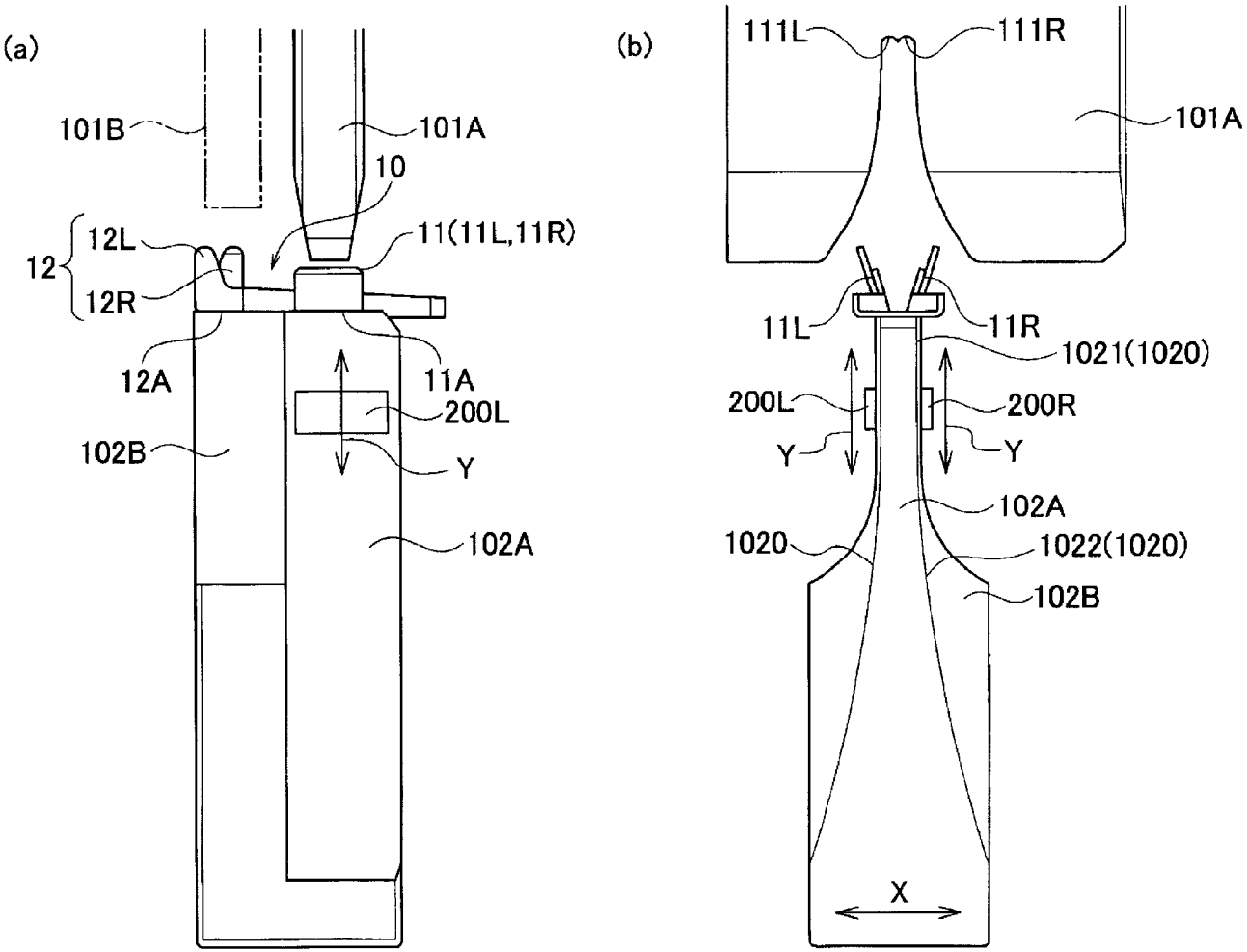
FIG. 4(*a*) is a side view showing the configuration of the main part of the terminal crimping apparatus of the second embodiment, and FIG. 4(*b*) is a front view thereof.
Figure 5:
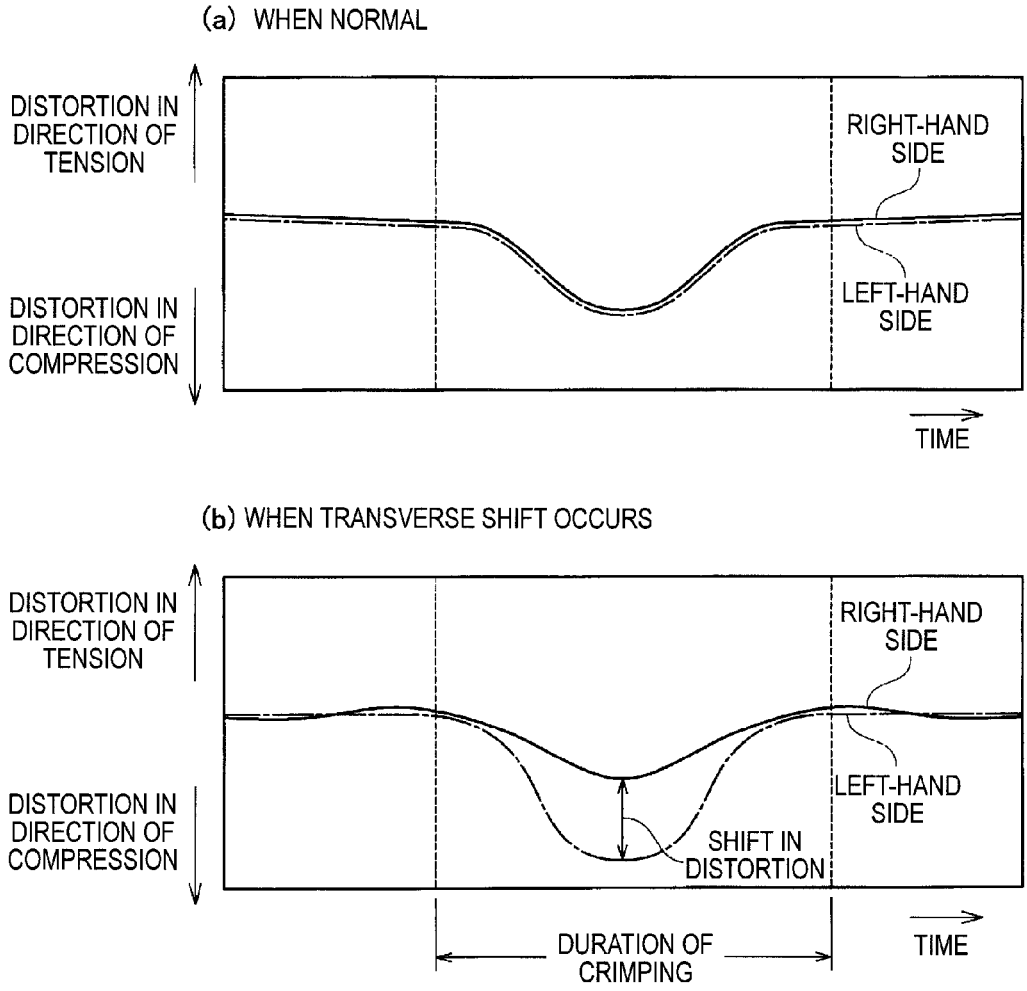
FIG. 5 shows characteristic charts showing data detected by left and right distortion gauges of the terminal crimping apparatus of the second embodiment, of which (a) shows a state in which a normal crimping is performed, and (b) shows a state in which an abnormal crimping is performed due to a transverse shift in load.
Figure 6:
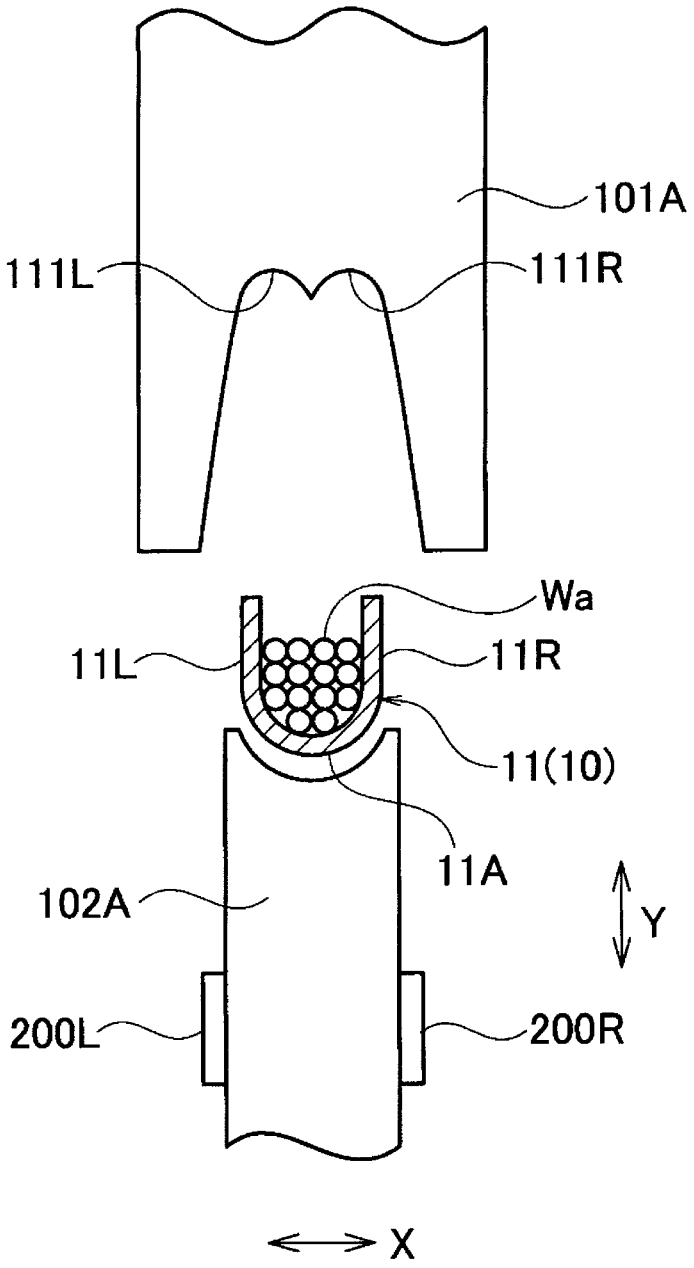
FIG. 6 is a drawing showing a normal positional relationship between a crimper, an anvil and a terminal when crimping is performed in the terminal crimping apparatus of the second embodiment.
Figure 7:
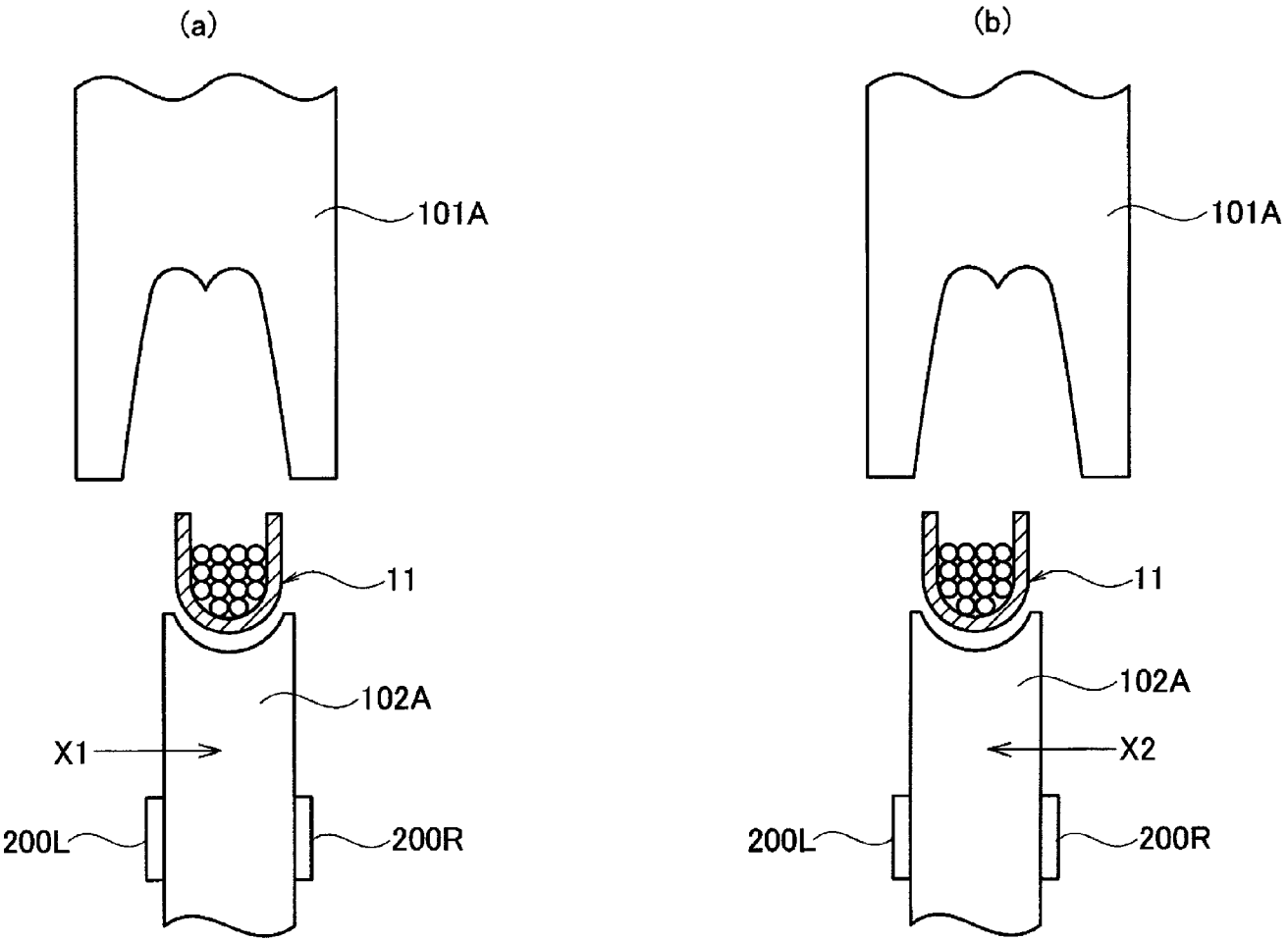
FIG. 7 shows abnormal positional relationships between the crimper, the anvil and the terminal when crimping is performed in the terminal crimping apparatus of the second embodiment, of which (a) is a drawing showing a state in which the anvil is offset in a direction indicated by an arrow x1 (in a rightward direction) relative to the crimper, and (b) is a drawing showing a state in which the anvil is offset in a direction indicated by an arrow x2 (in a leftward direction) relative to the crimper.
Figure 8:
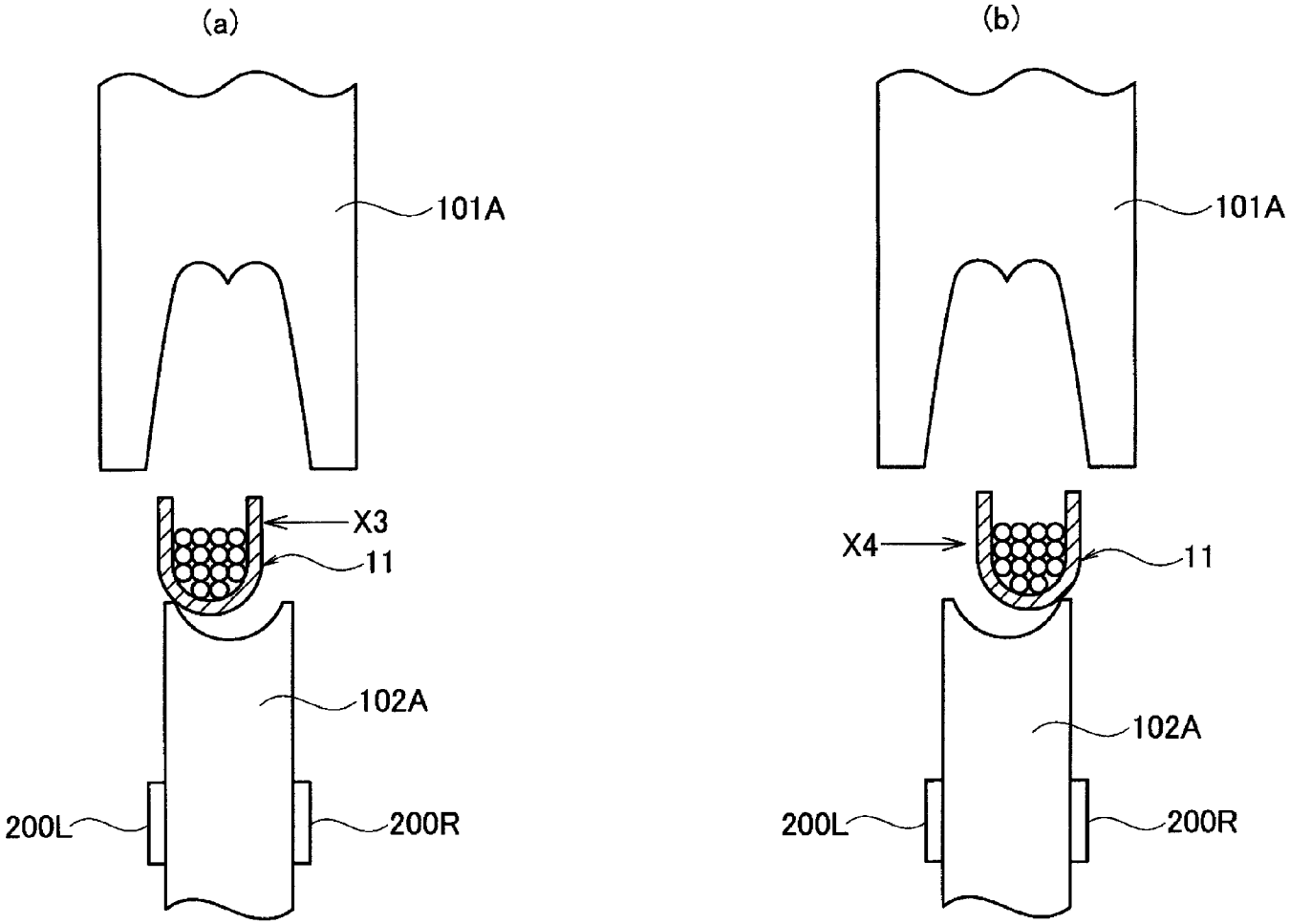
FIG. 8 shows abnormal positional relationships between the crimper, the anvil and the terminal when crimping is performed in the terminal crimping apparatus of the second embodiment, of which (a) is a drawing showing a state in which the terminal is offset in a direction indicated by an arrow x3 (in a leftward direction) relative to the crimper and the anvil, and (b) is a drawing showing a state in which the terminal is offset in a direction indicated by an arrow x4 (in a rightward direction) relative to the crimper and the anvil.
Figure 9:
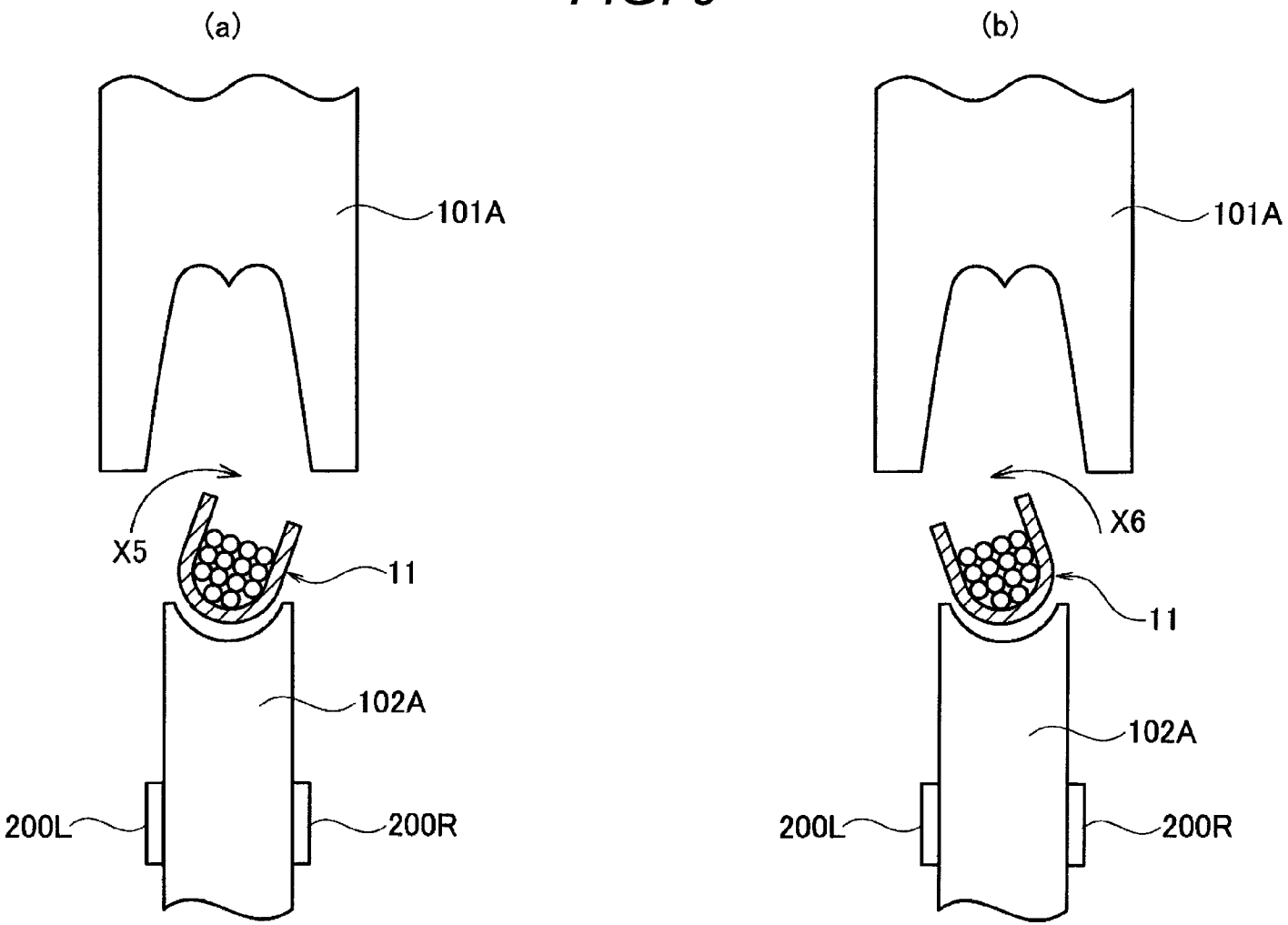
FIG. 9 shows abnormal positional relationships between the crimper, the anvil and the terminal when crimping is performed in the terminal crimping apparatus of the second embodiment, of which (a) is a drawing showing a state in which the terminal is inclined in a direction indicated by an arrow x5 (in a rightward direction) relative to the crimper and the anvil, and (b) is a drawing showing a state in which the terminal is inclined in a direction indicated by an arrow x6 (in a leftward direction) relative to the crimper and the anvil.

FIG. 3 is a perspective view showing the configuration of a main part of a terminal crimping apparatus of a second embodiment, FIG. 4(*a*) is a side view showing the configuration of the main part of the terminal crimping apparatus of the second embodiment, FIG. 4(*b*) is a front view thereof, FIG. 5 shows characteristic charts showing data detected by left and right distortion gauges of the terminal crimping apparatus of the second embodiment, of which (a) shows a state in which a normal crimping is performed, and (b) shows a state in which an abnormal crimping is performed due to a transverse shift in load. FIG. 6 is a drawing showing a normal positional relationship between a crimper, an anvil and a terminal when crimping is performed in the terminal crimping apparatus of the second embodiment. In addition, FIGS. 7 to 9 show abnormal positional relationships between the crimper, the anvil and the terminal when crimping is performed in the terminal crimping apparatus of the second embodiment, in which FIG. 7(*a*) is a drawing showing a state in which the anvil is offset in a direction indicated by an arrow X1 (in a rightward direction) relative to the crimper, FIG. 7(*b*) is a drawing showing a state in which the anvil is offset in a direction indicated by an arrow X2 (in a leftward direction) relative to the crimper, FIG. 8(*a*) is a drawing showing a state in which the terminal is offset in a direction indicated by an arrow X3 (in a leftward direction) relative to the crimper and the anvil, FIG. 8(*b*) is a drawing showing a state in which the terminal is offset in a direction indicated by an arrow X4 (in a rightward direction) relative to the crimper and the anvil, FIG. 9(*a*) is a drawing showing a state in which the terminal is inclined in a direction indicated by an arrow X5 (in a rightward direction) relative to the crimper and the anvil, and FIG. 9(*b*) is a drawing showing a state in which the terminal is inclined in a direction indicated by an arrow X6 (in a leftward direction) relative to the crimper and the anvil.

Similar to the terminal crimping apparatus shown in FIGS. 10(*a*) and (*b*), a terminal 10 which his to be crimped here has a conductor crimping portion 11 and a cover crimping portion 12 which are provided at a rear portion of the terminal 10 in a position situated at a front and a position situated at a rear of the rear portion, respectively. The conductor crimping portion 11 has a U-shaped cross section and has a bottom plate 11A which is a common substrate of the terminal 10 which extends over an overall length thereof and a pair of left and right crimping pieces 11L, 11R which rise from side edges of the bottom plate 11A which face each other in a transverse direction. Likewise, the cover crimping portion 12 has a U-shaped cross section and has a bottom plate 12A and a pair of left and right crimping pieces 12L, 12R which rise from side edges of the bottom plate 12A which face each other in the transverse direction.

Similar to the terminal crimping apparatus shown in FIG. 11, the terminal crimping apparatus has a set of an anvil (that is, a lower die) 102A and a crimper (that is, an upper die) 101A which crimps the conductor crimping portion 11 for pressure connection and a set of an anvil 102B and a crimper 101B which crimps the cover crimping portion 12. By lowering the crimpers 101A, 101B, the terminal 10 and an electric wire W which are inserted between the anvils 102A, 102B and the crimpers 101A, 101B are pressure connected or crimped together.

In FIGS. 3 to 9, only the set of the anvil (the lower die) 102A on which the bottom plate 11A of the conductor crimping portion 11 is placed and the crimper (the upper die) 101A which is situated above the anvil 102A are shown. The crimper 101A is caused to rise and fall by a driving mechanism, not shown, and when it is lowered, the crimper 101A presses to crimp the pair of crimping pieces 11L, 11R of the conductor crimping portion 11 together with the anvil 102A. The crimper 101A has two arch-shaped crimping portions 111L, 111R which are made up of arc-like surfaces and which are provided at a portion of the crimper 101A which faces the anvil 102A.

In the second embodiment, as FIGS. 3 and 4 show, vertical surfaces 1021 are provided at upper portions of a pair of transversely symmetrical lateral surfaces 1020, 1020 of the anvil 102A so as to maintain a transverse width of the anvil 102A constant, and inclined surfaces are provided below the vertical surfaces 1021 so as to expand the transverse width of the anvil 102A as it extends downwards. These inclined surfaces are formed of concave round surfaces (that is, arc-like surfaces) 1022 having a large radius of curvature which are continuous smoothly with the vertical surfaces 1021, and distortion gauges 200L, 200R are affixed on to the vertical surfaces 1021 or boundaries between the vertical surfaces 1021 and the round surfaces 1022 in two locations which are symmetrical with each other so as to detect vertical distortions at two locations on the anvil 102A which are spaced apart from each other in the transverse direction X. Consequently, an unbalanced load which acts on the anvil 102A during the crimping process can be detected based on detection data of the pair of left and right distortion gauges 200L, 200R.

When connecting together the terminal 10 and the electric wire W by use of the terminal crimping apparatus, firstly, the bottom plate 11A of the conductor crimping portion 11 of the terminal 10 is placed on the anvil 102A, and the bottom plate 12A of the cover crimping portion 12 of the terminal 10 is placed on the anvil 102B. Next, a conductor Wa (refer to FIG. 10) which is exposed by removing an insulation cover Wb of an end portion of the electric wire W is placed on the bottom plate 11A of the conductor crimping portion 11, and a portion of the electric wire W which lies adjacent to the conductor Wa and which is covered with the insulation cover Wb is placed on the bottom plate 12A of the cover crimping portion 12. Following this, in this state, the crimper 101A is lowered relative to the anvil 102A of the terminal crimping apparatus. Then, the two arch-shaped crimping portions 111L, 111R which are made of the arc-shaped surfaces and which are provided at the portion of the crimper 102A which face the anvil 102A gradually round inwards the pair of crimping pieces 11L, 11R and finally, the crimping pieces 11L, 11R are crimped on to the conductor Wa to crimp the conductor Wa, whereby the conductor crimping portion 11 of the terminal 10 is pressure connected or crimped to the conductor Wa of the electric wire W. At the same time, by the action of the other set of the crimper 101B and the anvil 102B (refer to FIG. 11), the pair of left and right crimping pieces 12L, 12R of the cover crimping portion 12 are bent inwards, the cover crimping portion 12 of the terminal 10 is fixedly crimped on to the portion of the electric wire W which is covered with the insulation cover Wb to crimp the portion concerned. Thus, the terminal 10 is connected to the electric wire W.

In this crimping process, the pair of left and right distortion gauges 200L, 200R which are affixed to the lateral surfaces 1020 of the anvil 102A output vertical distortion data in the two locations which are symmetrical with each other and which are spaced apart from each other in the transverse direction X. When the left and right distortion data are superposed on each other as is shown in FIG. 5(*a*), judging that there exists no transverse unbalanced load, it can be determined that a proper crimping has been performed. On the other hand, when the left and right distortion data are different from each other as is shown in FIG. 5(*b*) (that is, when there exists a large shift in distortion between the left and right distortion data), judging that an unbalanced crimping load is generated for some reason, it can be determined that a crimping failure mode occurs which produces a transversely asymmetrical crimped shape.

In this way, a defective crimping can be detected easily based on the data obtained by the distortion gauges 200L, 200R. In addition, this is the inspection based on distortion generated in the anvil 102A when crimping is performed, and therefore, crimped products can be subjected to a non-destructive total inspection.

To raise cases which are actually considered as specific examples, as FIG. 6 shows, when a crimping is performed in such a state that the crimper 101A, the anvil 102A and the terminal 10 are in the proper positional relationship, the data shown in FIG. 5(*a*) can be obtained which shows the normal condition, and therefore, it can be determined based on the data that the crimping has been performed normally. On the other hand, when the anvil 102A is offset in the direction indicated by the arrow X1 (in the rightward direction) or in the direction indicated by the arrow X2 (in the leftward direction) relative to the crimper 101A as is shown in FIGS. 7(*a*) and (*b*), or when the terminal 10 is offset in the direction indicated by the arrow X3 (in the leftward direction) or in the direction indicated by the arrow X4 (in the rightward direction) relative to the crimper 101A and the anvil 102A as is shown in FIGS. 8(*a*) and (*b*), or when the terminal 10 is inclined in the direction indicated by the arrow X5 (in the rightward direction) or in the direction indicated by the arrow X6 (in the leftward direction) relative to the crimper 101A and the anvil 102A as is shown in FIGS. 9(*a*) and (*b*), a shift in distortion as is shown in FIG. 5(*b*) appears, and therefore, it can be determined that it is highly possible that a defective crimping has occurred.

In this case, an unbalanced distortion generated in the anvil 102A can be detected by the distortion gauges 200L, 200R which are disposed on the pair of left and right lateral surfaces 1020, 1020 of the anvil 102A, and therefore, the left and right crimping loads can be compared relatively. Thus, even when production errors are generated in anvils, a threshold for a determination criterion does not have to be severe. In addition, the distortion gauges 200L, 200R only have to be affixed to the lateral surfaces 1020 of the anvil 102A, and therefore, no sensor having a large capacity which can bear a high load has to be used although used in the conventional example, thereby making it possible to realize a reduction in equipment costs.

In addition, when data are analyzed by use of a sensor which detects a large load as in the conventional example, it has been difficult to detect a crimping failure mode with a small load change. However, by analyzing data using the distortion gauges 200L, 200R which are affixed to the lateral surfaces 1020 of the anvil 102A, it is possible to detect a crimping failure mode with a small load change like a crimping failure mode which produces a transversely asymmetrical crimped shape in an ensured fashion.

Further, in the terminal crimping apparatus of this embodiment, the distortion gauges 200L, 200R are disposed on the vertical surfaces 1021 or on the boundaries between the vertical surfaces 1021 and the round surfaces 1022 in the locations which are symmetrical with each other, of the lateral surface 1020 of the anvil 102A. Therefore, distortions generated in a vertical direction Y in the lateral surface 1020 of the anvil 102A can be detected with good accuracy, thereby making it possible to increase the accuracy with which a crimping failure is determined.

This patent application is based on Japanese Patent Application (No. 2009-163573) filed on Jul. 10, 2009 and Japanese Patent Application (No. 2009-258535) filed on Nov. 12, 2009, the contents of which are to be incorporated herein by reference.

INDUSTRIAL APPLICABILITY

The terminal crimping apparatus according to the invention can detect a crimping failure mode which produces a transversely asymmetrical crimped shape in a crimped product, and therefore can be applied effectively to a terminal crimping process in which a terminal and an electric wire are connected together.

DESCRIPTION OF REFERENCE NUMERALS AND CHARACTERS

10 terminal; 11 conductor crimping portion; 11A bottom plate; 11L, 11R crimping piece; 101A crimper (upper die); 102A anvil (lower die); 105 support member; 1020 lateral surface; 1021 vertical surface; 1022 round surface (arc-like surface); 111L, 111R crimping portion; 150 facing close attaching surface; 200 contact surface pressure sensor; 200L, 200R distortion gauge; X transverse direction; Y vertical direction; W electric wire; Wa conductor.

The invention claimed is:

1. A terminal crimping apparatus having a left and right immediately adjacent sides in a transverse direction, comprising:

a lower die configured to receive a bottom plate of a conductor crimping portion of a terminal, the conductor crimping portion being made up of the bottom plate and a pair of left and right crimping pieces, corresponding with the left side and the right side respectively, which rise from side edges of the bottom plate which face each other in the transverse direction;

an upper die being disposed above the lower die and configured to press the crimping pieces of the conductor crimping portion between the lower die and itself, the upper die having two arch-shaped crimping portions, aligned in and facing each other in the transverse direction and sharing a common point of intersection, each having an arc-like surface and formed at a portion thereof which faces the lower die so as to bend inwards the pair of left and right crimping pieces, wherein the bottom plate of the conductor crimping portion of the terminal is configured to be placed on the lower die, a distal end portion of a conductor of an electric wire is configured to be placed on the bottom plate, and in this state, the upper die is configured to be relatively pressed towards the lower die so as to round inwards the pair of left and right crimping pieces so that the crimping pieces are pressure-connected to the conductor of the electric wire; and a detection device having a detecting portion located on each of the left side and the right side respectively configured to detect a transversely-unbalanced load applied to the upper and lower dies in a crimping process in which the upper die is configured to be relatively pressed towards the lower die so that the pair of left and right crimping pieces are crimped for pressure connection to the conductor of the electric wire, wherein contact surface pressure sensors are disposed as the detecting portions in two positions, which are situated between an outer surface of the upper die and an inner surface of a support member which supports the upper die and which are transversely-symmetrical.

2. The terminal crimping apparatus as set forth in claim 1, wherein the terminal crimping apparatus is configured to detect the transversely-unbalanced load based on a difference in detection data from the individual pressure sensors.

3. A terminal crimping apparatus having a left and right immediately adjacent sides in a transverse direction, comprising:

a lower die configured to receive a bottom plate of a conductor crimping portion of a terminal, the conductor crimping portion being made up of the bottom plate and a pair of left and right crimping pieces, corresponding with the left side and the right side respectively, which rise from side edges of the bottom plate and face each other in a transverse direction;

an upper die being disposed above the lower die and configured to press the crimping pieces of the conductor crimping portion between the lower die and itself, and which has two arch-shaped crimping portions, aligned in and facing each other in the transverse direction and sharing a common point of intersection, each having an arc-like surface and formed at a portion thereof which faces the lower die so as to bend inwards the pair of left and right crimping pieces, wherein the bottom plate of the conductor crimping portion of the terminal is configured to be placed on the lower die, a distal end portion of a conductor of an electric wire is configured to be placed on the bottom plate, and in this state, the upper die is configured to be relatively pressed towards the lower die so as to round inwards the pair of left and right crimping pieces so that the crimping pieces are pressure-connected to the conductor of the electric wire; and a detection device having a detecting portion located on each of the left side and the right side respectively configured to detect a vertically unbalanced distortion in at least two locations on the lower die which are spaced apart in a transverse direction in a crimping process in which the upper die is configured to be relatively pressed towards the lower die so that the pair of left and right crimping pieces are crimped for pressure connection to a conductor of the electric wire, wherein distortion gauges are disposed in two locations on a pair of transversely-symmetrical lateral surfaces of the lower die, so that the vertical unbalance is detected based on a difference in detection data from the individual distortion gauges, and wherein vertical surfaces are provided at upper portions of a pair of transversely-symmetrical lateral surfaces of the lower die no as to maintain a transverse width of the lower die constant, inclined surfaces are provided below the vertical surfaces so as to expand the transverse width of the lower die as it extends downwards, the inclined surfaces are formed of concave arc surfaces which are continuous smoothly with the vertical surfaces, and the distortion gauges are affixed onto the vertical surfaces or boundaries between the vertical surfaces and the arc surfaces.

* * * * *